United States Patent [19]

Kennedy et al.

[11] Patent Number: 4,479,326

[45] Date of Patent: Oct. 30, 1984

[54] SPARKING TOY VEHICLE AND LAUNCHER

[75] Inventors: Melvin R. Kennedy, New York, N.Y.; Dietmar Nagel, Chester, N.J.; Abraham Arad, Westport, Conn.

[73] Assignee: Buddy L Corporation, New York, N.Y.

[21] Appl. No.: 478,237

[22] Filed: Mar. 24, 1983

[51] Int. Cl.[3] ..... A63H 33/36

[52] U.S. Cl. ..... 446/23

[58] Field of Search ..... 46/10, 48, 206, 202, 46/201, 209

[56] References Cited

U.S. PATENT DOCUMENTS

| | | | |
|---|---|---|---|
| 1,538,205 | 5/1925 | Munday | 46/209 |
| 2,788,613 | 4/1957 | Gelfand et al. | 46/209 X |
| 2,826,860 | 3/1958 | Ashley et al. | 46/10 |
| 3,750,328 | 8/1973 | Nielsen et al. | 46/206 X |

*Primary Examiner*—Mickey Yu

*Attorney, Agent, or Firm*—Michael Ebert

[57] ABSTRACT

A toy vehicle-projecting gun assembly in which the vehicle is normally latched on an inclined ramp with its rear wheels raised and free to turn, the ramp extending from the front end of the power chamber of the gun. Joined to the rear end of the chamber is a gun stock provided at its underside with a power trigger operated by the trigger finger of the player and on its topside with a firing button operated by the player's thumb. When the trigger is actuated, it acts through a gear train disposed in the power chamber to turn a drive gear mounted on the rear wheel axle, the drive gear being coupled to an energy-storing flywheel functioning as the vehicle motor. After the motor is revved up by repeated trigger actions, the player presses the firing button which operates an unlatching mechanism to release the vehicle which then shoots down the ramp.

8 Claims, 6 Drawing Figures

Fig. 2.
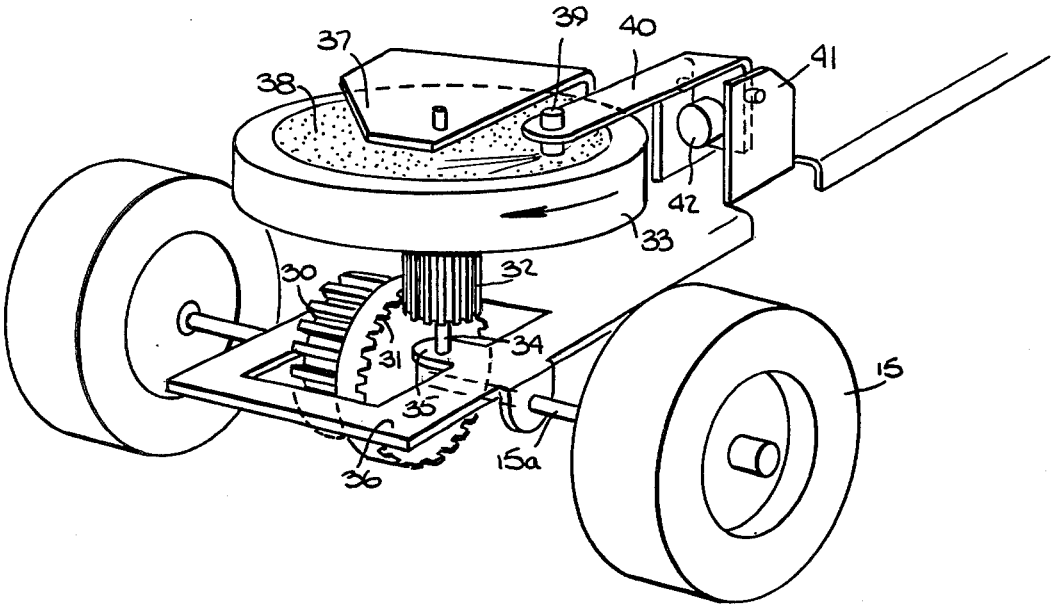
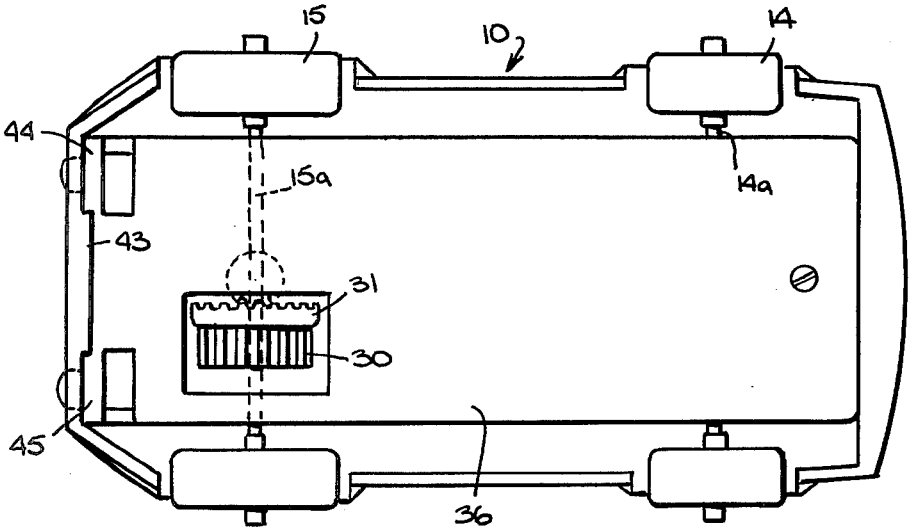
Fig. 3.

SPARKING TOY VEHICLE AND LAUNCHER

BACKGROUND OF INVENTION

Field of Invention

This invention relates generally to toy vehicles or miniature racing cars, and in particular to a toy vehicle-projecting gun assembly in which the vehicle is normally latched on an inclined ramp extending from the power chamber of the gun, the released vehicle shooting down the ramp when the gun is fired.

Toy vehicles or miniature racing cars are known which makes use of spring-powered wind-up motors. In recent years, such racing cars have been combined with a launching platform or ramp on which the wound-up car is latched, the car being released by an unlatching mechanism to run down the ramp onto a playing surface.

In one commercially-available version of a toy vehicle and launching platform assembly, the platform is strapped onto the wrist of the player and the vehicle is housed within a transparent cover hinged to the platform. In order to launch the car after it is wound up, one must first pull out a retractable ramp from the front end of the platform and then push a button which acts to release a latch that permits the cover to swing up to expose the car. But this push-button action does not free the wound-up car; for to effect release, the button must again be depressed, this action serving to displace a lug which normally retains the car on the platform.

There are several practical drawbacks in a toy vehicle and wrist-strapped launching platform assembly. The first is that it entails a relatively complicated operating procedure and in the hands of a typical pre-school child this is difficult to carry out. Even before the car is placed on the platform and latched thereon, it must be wound up; and with a tiny vehicle, it is not feasible to use a large winding key or a high capacity spring. Also it is difficult to direct the car by orienting the wrist of the player relative to a playing surface.

Also known are toy vehicles which employ as the motor therefor an energy-storing flywheel coupled to one set of the wheels. In order to rev up the flywheel, one must hold the car and push it along the ground for a short distance to turn the wheels operatively coupled to the flywheel, this action being repeated until the flywheel has acquired sufficient momentum to drive the vehicle for a fair distance along a playing surface. In other versions of toy vehicles having a flywheel motor, the flywheel is set into motion by pulling a string or a tape having a ratchet formation. In all such versions, difficulties are experienced by pre-shool children in in imparting sufficient momentum to the flywheel.

SUMMARY OF INVENTION

In view of the foregoing, the main object of this invention is to provide a toy vehicle-projecting gun assembly in which the vehicle is normally latched on an inclined ramp extending from the power chamber of the gun, which gun may be pointed at a playing surface by the player and then fired to cause the released vehicle to shoot down the ramp onto the playing surface.

More particularly, an object of this invention is to provide an assembly of the above type in which the vehicle includes a flywheel motor that is caused to acquire momentum by repeatedly actuating the power trigger of the gun.

Also an object of the invention is to provide an assembly of the above type which even a pre-shool child finds easy to operate, the assembly being of relatively simple and inexpensive design.

A significant feature of the invention lies in its high play value, for the toy combines the features of operating a gun that can be aimed and fired with the features of a racing car. This makes it possible for two or more players to compete on more than one level. Thus, assuming that the object of a competition is to see which player can bring his vehicle as close as possible to a target placed on a long runway which a fixed distance from a starting line, then the winner is that player who is able not only to rev up the flywheel to the extent necessary to reach the target, but who also accurately points his gun toward the target.

Yet another object of the invention is to provide a vehicle whose flywheel motor generates sparks that are visible through the windows of the vehicle, without imposing a drag on the flywheel, the sparks giving the impression of a high power motor.

Briefly stated, these objects are attained in a toy vehicle-projecting gun assembly in which the vehicle is normally latched on an inclined ramp with its rear wheels raised and free to turn, the ramp extending from the front end of the power chamber of the gun. Joined to the rear end of the chamber is a gun stock provided at its underside with a power trigger operated by the trigger finger of the player and its topside with a firing button operated by the player's thumb. When the trigger is actuated, it acts through a gear train disposed in the power chamber to turn a drive gear mounted on the rear wheel axle, the drive gear being coupled to an energy-storing flywheel functioning as the vehicle motor. After the motor is revved up by repeated trigger actions, the player presses the firing button which operates an unlatching mechanism to release the vehicle which then shoots down the ramp.

OUTLINE OF DRAWINGS

For a better understanding of the invention as well as other objects and further features thereof, reference is made to the following detailed description to be read in conjunction with the accompanying drawings, wherein:

FIG. 2 is a perspective view of the rear wheels of the vehicle and a flywheel associated therewith which is disposed within the body of the vehicle, the body being omitted in this figure;

FIG. 3 is a bottom view of the vehicle;

DESCRIPTION OF INVENTION

The Assembly

Figure 1:
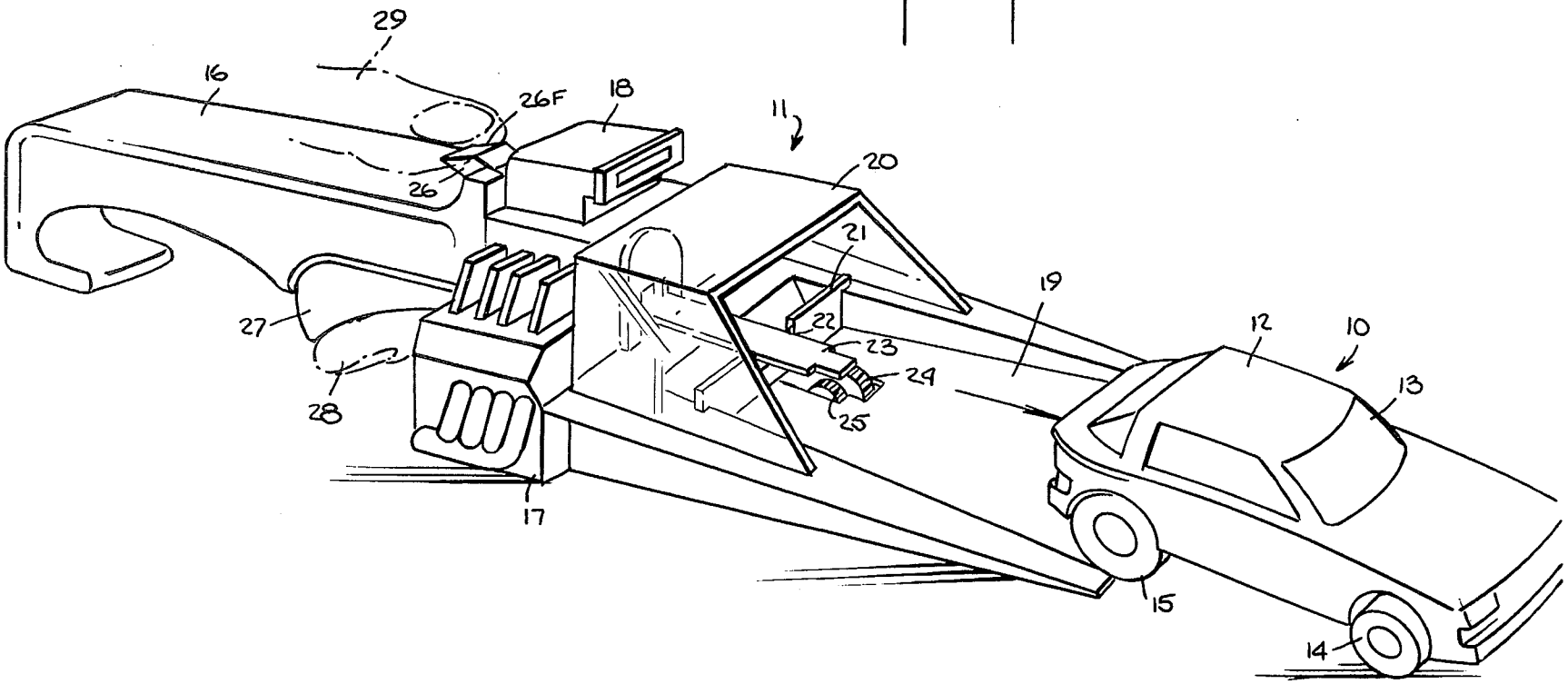
FIG. 1 is a perspective view of a toy vehicle-projecting gun assembly in accordance with the invention, the vehicle being shown just after it has been fired from the gun.

Referring now to FIGS. 1, 2 and 3, there is shown a toy vehicle-projecting gun assembly, the vehicle being generally designated by reference numeral 10 and the gun by reference numeral 11.

Vehicle 10 is provided with a car body that simulates the appearance of a racing car having front, side and rear windows 13, these being formed of a molded, translucent plastic sheet. The vehicle includes a pair of front wheels 14 and a pair of rear wheels 15, these being mounted on axles 14A and 15A.

Gun 11, all of whose components are molded of synthetic plastic material of good structural strength, includes a handle or stock 16 extending from the rear end of a power chamber 17 above which is a simulated gun sight 18. Extending from the front end of power chamber 17 is an inclined ramp 19 whose upper section is covered by a transparent plastic canopy 20. Under the canopy on the ramp is an upright ledge 21 having a center notch 22 to accommodate a retractable firing tongue 23. Below the tongue adjacent ledge 21 is the output gear 24 of a gear train and its associated pinion 25, these being partially sunk within a recess in the horizontal floor of the ramp.

Firing tongue 23 is operated by a plunger 26 which is hollow and has a square cross section, the plunger passing through an opening in the top side of stock 16 and extending into power chamber 17 at an angle with respect to the top side of the stock. The upper end of the plunger which projects above the surface of the stock functions as a firing button 26F.

Pivotally mounted in stock 16 and projecting below the underside thereof is a power trigger 27. The relationship of firing button 26F to trigger 27 is such that a player grasping the stock is able to manipulate the trigger with his trigger finger 28 while pressing the firing button with his thumb 29.

As shown in FIGS. 2 and 3, mounted on the rear wheel axle 15A of the vehicle is a drive gear 30 having on one side thereof a crown gear 31 which engages the pinion 32 of a flywheel 33 supported for rotation within the body of the car. The flywheel and its pinion are supported on a vertical shaft 34. The lower end of shaft 34 is held in a bearing tab 35 integral with the chassis 36 of the vehicle, the upper end of the shaft being held in a bracket bearing 37 mounted on the chassis.

Thus when the drive gear 30, while the vehicle is in its latched position on the ramp, engages the output gear 24 and is turned thereby, this causes rear wheels 15 to rotate and at the same time, through crown gear 31 and pinion 32, causes flywheel 33 to rotate in a plane at right angles to the vertical axis of axle 34.

The upper surface of flywheel 33 is provided with a layer 38 of abrasive material, and this layer is engaged by a flint 39 mounted at the free end of an arm 40. The other end of arm 40 is bent down into a right angle which is trunnioned on a bracket 41 and is provided with a counter weight 42. This counter weight serves to apply a slight downward pressure on flint 39 so as to generate sparks as the flywheel turns, without, however, imposing a significant drag on the flywheel. These sparks are visible through the windows of the vehicle and simulate motor activity.

Firing tongue 23 is shown in FIG. 1 in its normally extended position. In order to latch vehicle 10 on ramp 19, the vehicle is pushed up the ramp so that tongue 23 then enters a center slot 43 (see FIG. 2) on the undercarriage at the rear of the vehicle. This slot is flanked on either side by angled sleds 44 and 45.

Figure 4:
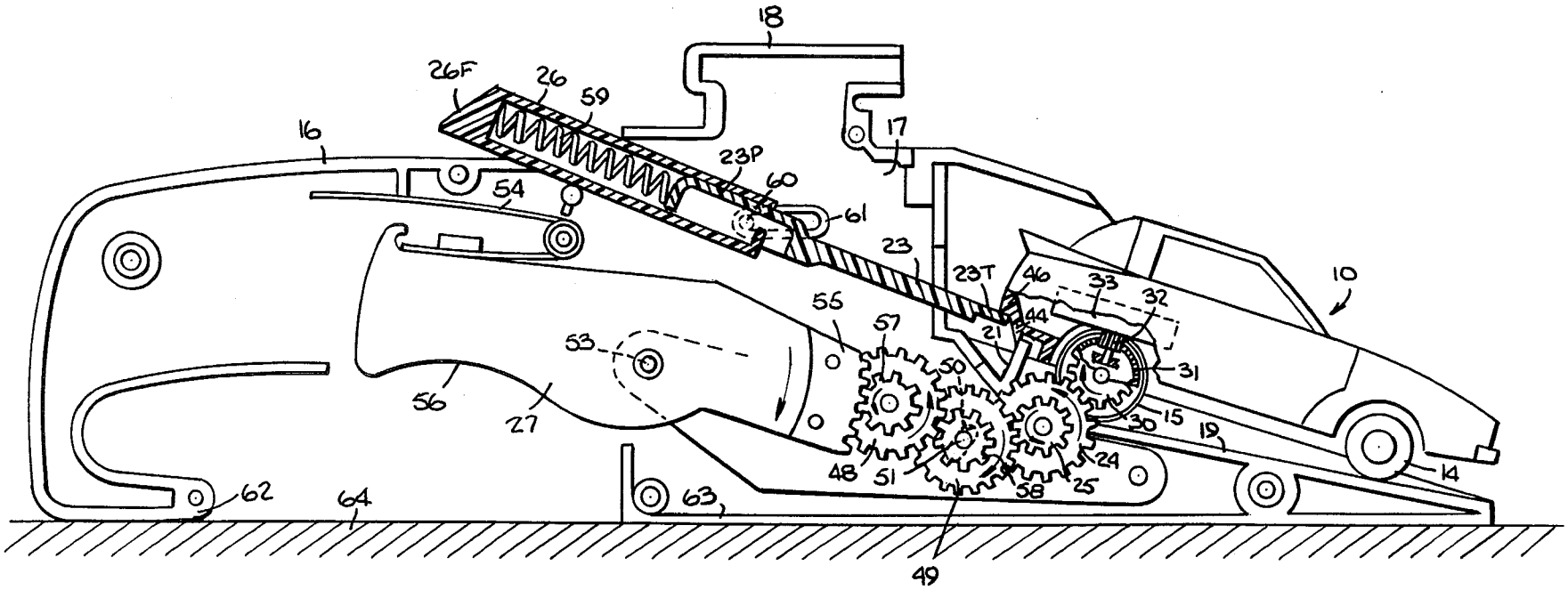
FIG. 4 is a longitudinal section of the assembly in the state where the vehicle is latched in position on the ramp and where the trigger of the gun is being manipulated to cause a gear segment at the end thereof to swing downwardly to operate a gear train in the power chamber of the gun to effect rotation of the rear wheels of the vehicle.

When, therefore, the vehicle is pushed back against ledge 21 on the ramp, sleds 44 and 45 ride over the ledge and the sleds then fall behind the ledge to latch the vehicle. This is shown in FIG. 4, where it will be seen that the tip 23T of tongue 23 lies under a shoulder 46 in the rear of the undercarriage and that sled 44 lies behind ledge 21 at the upper section of ramp 19. In this latched state, rear wheels 15 are raised slightly above the surface of ramp 19 and are therefore free to turn.

The Power Trigger System

In the latched position, as shown in FIG. 4, output gear 24 is in engagement with drive gear 30 of the vehicle, this output gear being the last gear in a gear train that further includes an input gear 48, and an idler gear 49. The axle 51 of idler gear 49 is received in a fixed bearing having an elongated slot 50 as shown in dotted lines, so that the idler gear is free to move into or out of engagement with the pinion 25 of output gear 24 in the gear train.

Power trigger 27, which is pivoted on pin 53 in stock 16, is biased by a flat spring 54 which presses against the rear end of the trigger to cause the front end thereof to normally assume a raised position, this front end or nose having a gear segment 55 attached thereto. Trigger 27 is provided at the underside of its rear end with a finger rest 56; and when the trigger is operated by the trigger finger, gear segment 55 then swings in the clockwise direction, as indicated by the arrow in FIG. 4. This movement acts to turn the pinion 57 of the input gear 48, causing input gear 48 to turn in the counterclockwise direction, as indicated by the arrow thereon.

Input gear 48 engages the pinion 58 of idler gear 49; and because of its counterclockwise movement, this action imposes an upward force on pinion 58, causing the associated idler gear 49 whose axle 51 is shiftable within the fixed bearing formed by elongated slot 50 to move up with respect to fixed pin 51 to engage the pinion 52 of output gear 24.

Figure 5:
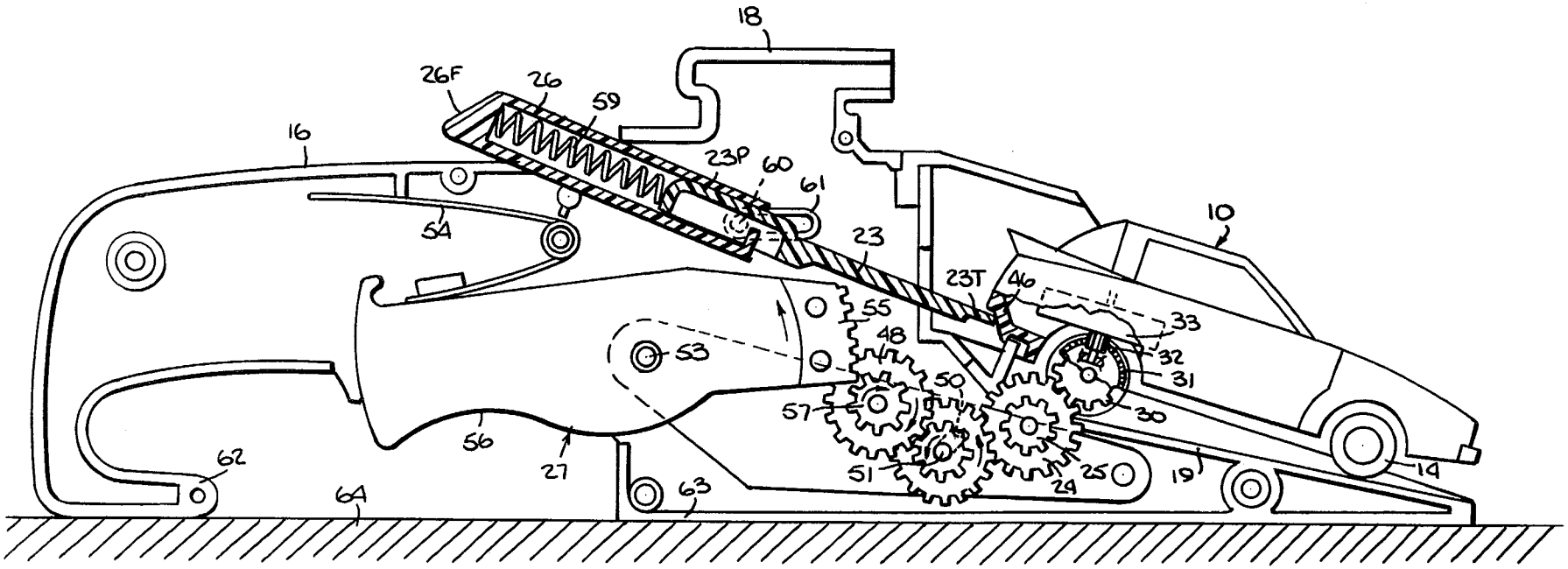
FIG. 5 is the same as FIG. 4, except that now the trigger gear segment swings upwardly, during which upward swing the rear wheels are not driven.

Thus every time trigger 27 is operated by a player against spring 54, the gear train acts to turn drive gear 24 to cause rotation of the raised rear wheels 15 and flywheel 33. This rotation only takes place when the gear segment 55 on the trigger moves clockwise. When the gear segment moves counterclockwise under the force of spring 54, as shown in FIG. 5, the input gear 48 of the train is caused to turn in the clockwise direction and to thereby impose a downward force on pinion 58 of idler gear 49, causing disengagement between this gear and the pinion 52 of output gear 24. Hence, even though trigger 27 is reciprocated by the trigger finger, this reciprocal action results only in unidirectional turning of drive gear 30 for the vehicle.

Firing Action

Figure 6:
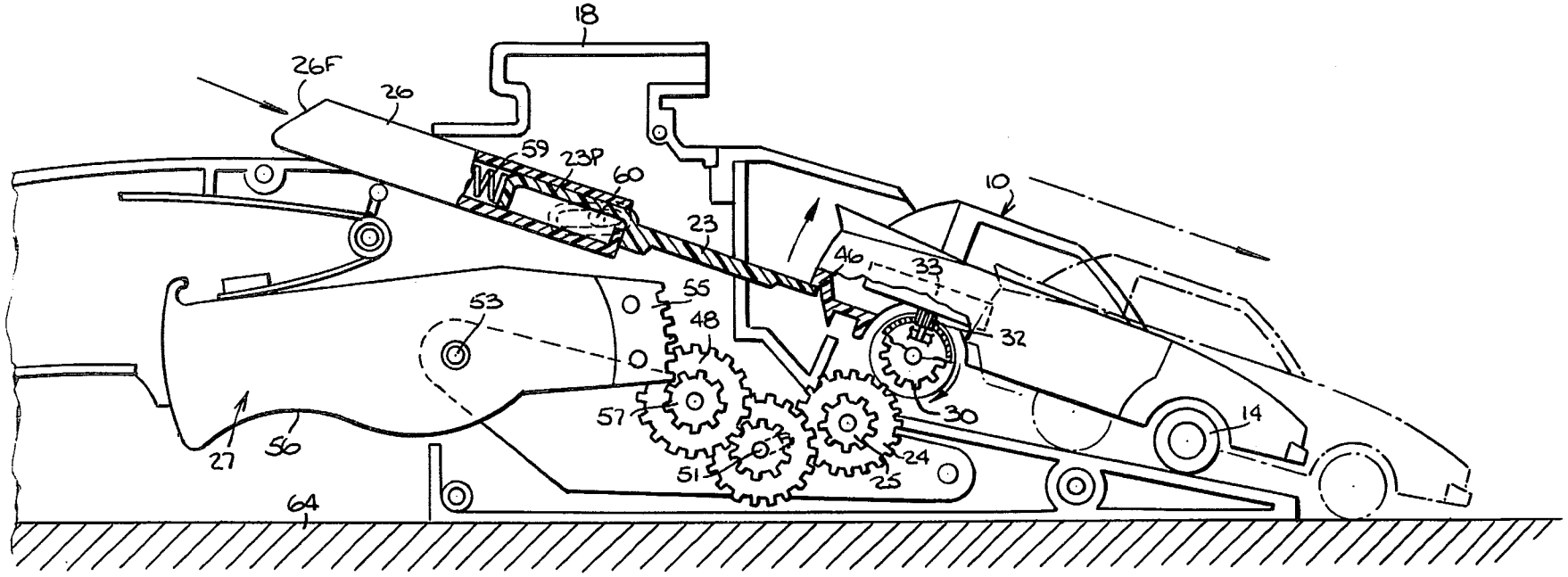
FIG. 6 is the same as FIG. 5, except that now the firing button has been actuated to operate an unlatching mechanism to release the vehicle.

As shown in FIGS. 4, 5 and 6, firing tongue 23 is provided at its upper end with a piston 23P which is received within hollow plunger 26. This piston is biased by helical spring 59 interposed between the head of piston 23P and the head of the plunger. The lower end of plunger 26 is provided with a guide pin 60 which is trapped within an elongated horizontal slot 61.

Hence when firing button 26F at the head of plunger 26 is pressed in to compress spring 59, the plunger is then caused by guide pin 60, as shown in FIG. 6, to shift upwardly from its initially downwardly inclined position to a somewhat less inclined position, thereby raising firing tongue 23, which acts to release the vehicle. At this point, tongue 23, whose piston 23P is subjected to the pressure of compressed spring 59, is projected forward to fire vehicle 10, which then shoots down the ramp 19 to run on a surface adjacent the end of the ramp.

As shown in FIGS. 4, 5, and 6, stock 16 is provided with a flat foot 62 which lies in the same plane as the base 63 of the inclined ramp 19. In practice, therefore, the player may rest the vehicle-projecting assembly on a horizontal playing surface 64 and rev up and fire the gun from this position, in which case vehicle 10 shoots down ramp 19 and runs on surface 64 for a distance determined by the energy stored in flywheel motor 23.

Alternatively, the player may hold the ramp and power chamber of the gun in the palm of one hand while grasping the stock in the other, and then bring the end of the ramp against any raised flat surface such as a table. He can then rev up the motor and fire the vehicle in the direction in which the gun is pointed.

Thus the assembly has all sorts of play possibilities, for the vehicle which shoots out of the gun can fly a short distance in space without changing its orientation and can therefore jump a gap between the end of the ramp and a nearby running surface. This brings into play still another skill; for the player must be able to judge the extent to which the projected vehicle is able to fly and still maintain its proper orientation for running on a surface.

While there has been shown and described a preferred embodiment of a toy vehicle-projecting gun assembly in accordance with the invention, it will be appreciated that many changes and modifications may be made therein without, however, departing from the essential spirit thereof. It is important also to recognize that the launching of the vehicle in which it is thrust forward by the spring-projected tongue when the gun is fired provides a distinct advantage. If the vehicle were simply released, the spinning flywheel would then be required to dissipate some of its energy in order to accelerate the vehicle up to running speed. However, the forward thrust accelerates the vehicle up to speed without slowing down the flywheel.

The spinning flywheel supported within the vehicle acts somewhat in the manner of a gyro whose operating behavior includes precessional motion. Thus by pointing the gun to position the launching ramp at various inclinations to the floor or tilted to one side or the other and then firing, the forward launching thrust combined with the gyro action produces a wide variety of stunts, such as rear wheelies, side wheelies, one wheel wheelies, spinouts, zig-zags and so on.

We claim:

1. A toy vehicle-projecting gun assembly which can be held in the hand of a player and pointed in a manner of a gun comprising:

A. a vehicle having axle-mounted front and rear wheels, a drive gear mounted in the rear axle and an energysaving flywheel mounted for rotation within the body of the vehicle and operatively coupled to the drive gear to function as the vehicle motor, whereby when the drive gear is rotated, the flywheel is caused to turn to store energy to power the vehicle;

B. a gun having a power chamber, an inclined ramp extending from the front end of the chamber and including latching means to retain the vehicle thereon with its rear wheels raised above the ramp and free to turn, and a stock extending from the rear end of the chamber;

C. a power trigger disposed on the underside of the stock which can be reciprocated by the trigger finger of the hand of a player grasping the stock;

D. a gear train disposed in said chamber to operatively couple the trigger to the drive gear and to convert the reciprocating action of the trigger into rotary motion to rotate the drive gear of the latched vehicle and thereby turn the flywheel to store energy;

E. a firing button disposed on the upper side of the stock which can be depressed by another finger of the hand of the player; and F. an unlatching mechanism operated by the firing button to release the vehicle from the latching means, whereby when the rotating flywheel has gained momentum and the firing button is pressed, the vehicle then shoots down the tamp to travel in a direction determined by how the player's hand points the gun assembly.

2. An assembly as set forth in claim 1, wherein said flywheel is mounted for rotation on a vertical shaft having a pinion thereon which engages a crown gear secured to one side of the drive gear.

3. An assembly as set forth in claim 2, wherein said vehicle is provided with translucent windows and said flywheel has a layer of abrasive material on one face thereof which is rubbed by a flint engaging said layer to generate sparks which are visible through the windows.

4. An assembly as set forth in claim 1, further including a spring to bias the trigger, whereby the trigger finger acts to produce an upward stroke of the trigger and the spring a downward stroke thereof.

5. An assembly as set forth in claim 4, wherein said gear train is provided with an input gear having a pinion which is engaged by and rotated by a gear segment attached to one end of the trigger, and an output gear which engages the drive gear when the vehicle is latched on said ramp.

6. An assembly as set forth in claim 1, wherein said latching means is constituted by an upright ledge on said ramp, and said vehicle is provided with inclined rear sleds on the rear of its undercarriage, which, when the vehicle is pushed up the ramp, rides over the ledge and falls therebehind to latch the vehicle.

7. An assembly as set forth in claim 6, wherein said unlatching mechanism is constituted by a firing tongue operated by the button and extending into a shoulder on the rear of the vehicle undercarriage, operation of the button causing the tongue to shift upwardly to raise the vehicle above the ledge and thereby release the vehicle.

8. An assembly as set forth in claim 7, wherein said button is the end portion of a hollow plunger which extends into the chamber at an inclined position, the tongue having a piston head which is received in the plunger and is subjected to pressure by a helical spring disposed in the plunger, said plunger having a guide pin which rides in a horizontal slot so that when the button is pressed, the plunger is caused to shift to a less inclined position and thereby lift the tongue to unlatch the vehicle.

* * * * *